US007812537B2

(12) United States Patent
Lee

(10) Patent No.: US 7,812,537 B2
(45) Date of Patent: Oct. 12, 2010

(54) PLASMA DISPLAY PANEL HAVING CENTER ELECTRODE

(75) Inventor: Kyung Wha Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 391 days.

(21) Appl. No.: 11/476,691

(22) Filed: Jun. 29, 2006

(65) Prior Publication Data

US 2007/0001599 A1 Jan. 4, 2007

(30) Foreign Application Priority Data

Jun. 30, 2005 (KR) ..... 10-2005-0058920

(51) Int. Cl.
*H01J 17/49* (2006.01)

(52) U.S. Cl. ..... 313/584; 313/585; 313/582

(58) Field of Classification Search ..... 313/582–585
See application file for complete search history.

(56) References Cited

U.S. PATENT DOCUMENTS 6,479,932 B1 * 11/2002 Nunomura ..... 313/582
6,727,870 B1 4/2004 Kim et al. ..... 345/60
6,747,409 B1 * 6/2004 Han et al. ..... 313/582
2002/0063510 A1 5/2002 Yura et al. ..... 313/483
2003/0146713 A1 8/2003 Nagao et al. ..... 315/169.4
2004/0032215 A1 2/2004 Nishimura et al. ..... 315/169.3
2005/0017636 A1 1/2005 Lin et al. ..... 313/582
2006/0061279 A1 * 3/2006 Kim ..... 313/582

FOREIGN PATENT DOCUMENTS

JP 11-126561 5/1999
WO WO 01/31674 A1 5/2001

OTHER PUBLICATIONS

European Search Report dated Oct. 12, 2006.

* cited by examiner

*Primary Examiner*—Karabi Guharay
(74) *Attorney, Agent, or Firm*—KED & Associates, LLP

(57) ABSTRACT

A plasma display panel is disclosed. The plasma display panel includes a first substrate, a second substrate, a first electrode and a second electrode formed on the first substrate, a center electrode and a third electrode. The center electrode includes a plurality of division electrodes for forming a plurality of discharge gaps between the first electrode and the center electrode and between the second electrode and the center electrode. The third electrode is formed on the second substrate to intersect the center electrode.

20 Claims, 7 Drawing Sheets

(a)

(b)

(a)

(b)

(a)

(b)

PLASMA DISPLAY PANEL HAVING CENTER ELECTRODE

This Non-provisional application claims priority under 35 U.S.C. §119(a) on Patent Application No. 10-2005-0058920 filed in Korea on Jun. 30, 2005 the entire contents of which are hereby incorporated by reference.

BACKGROUND OF THE INVENTION

1. Field of the Invention

This document relates to a plasma display panel.

2. Description of the Background Art

A plasma display panel comprises a front panel, a rear panel, and barrier ribs formed between the front panel and the rear panel. The barrier ribs form a plurality of discharge cells. Each of the discharge cells is filled with an inert gas containing a main discharge gas such as neon (Ne), helium (He) or a Ne—He gas mixture and a small amount of xenon (Xe). The plurality of discharge cells form one pixel. For example, a red (R) discharge cell, a green (G) discharge cell and a blue (B) discharge cell form one pixel.

When a high frequency voltage generates a discharge of the plasma display panel, the inert gas within the discharge cells generates vacuum ultraviolet rays. The vacuum ultraviolet rays emit a phosphor formed between the barrier ribs such that the image is displayed. Since the above-described plasma display panel can be manufactured to be thin and light, the plasma display panel has been considered as a display apparatus.

SUMMARY OF THE INVENTION

Embodiments of the present invention provide a plasma display panel capable of reducing the manufacturing cost and improving the manufacturing yield by changing a structure of an electrode formed on a substrate.

Embodiments of the present invention also provide a plasma display panel capable of improving emission brightness and discharge efficiency when discharging the plasma display panel by changing a structure of an electrode formed on a substrate.

According to an aspect, there is provided a plasma display panel comprising a first substrate, a first electrode and a second electrode formed on the first substrate, and a center electrode comprising a plurality of division electrodes for forming a plurality of discharge gaps between the first electrode and the center electrode and between the second electrode and the center electrode.

According to another aspect, there is provided a plasma display panel comprising a first substrate and a second substrate, a first electrode and a second electrode formed on the first substrate, a center electrode comprising a plurality of division electrodes for forming a plurality of discharge gaps between the first electrode and the center electrode and between the second electrode and the center electrode, and a third electrode formed on the second substrate to intersect the center electrode.

BRIEF DESCRIPTION OF THE DRAWINGS

The embodiment of the invention will be described in detail with reference to the following drawings in which like numerals refer to like elements.

DETAILED DESCRIPTION OF PREFERRED EMBODIMENTS

Figure 1:
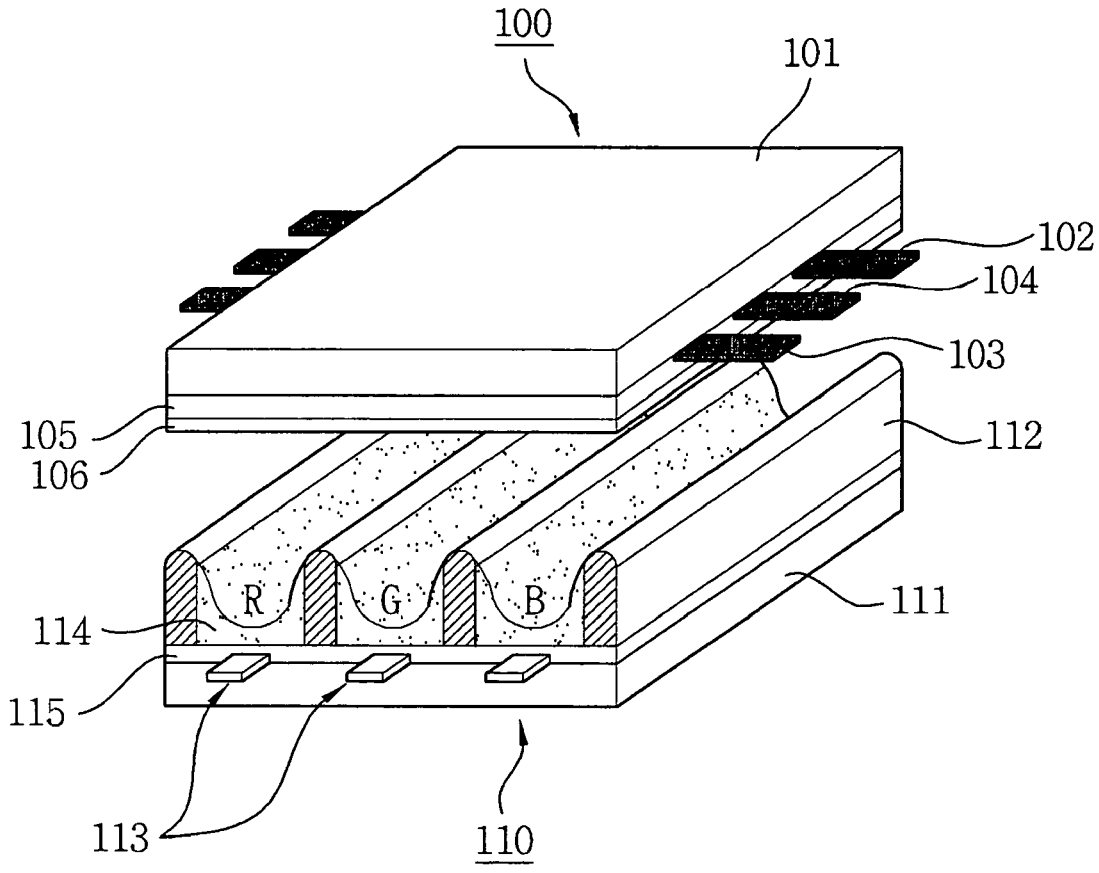
FIG. 1 illustrates a plasma display panel according to an embodiment of the present invention.

Embodiments of the present invention will be described in a more detailed manner with reference to the drawings.

A plasma display panel according to embodiments of the present invention comprises a first substrate, a first electrode and a second electrode formed on the first substrate, and a center electrode comprising a plurality of division electrodes for forming a plurality of discharge gaps between the first electrode and the center electrode and between the second electrode and the center electrode.

The first electrode and the second electrode may comprise either a scan electrode or a sustain electrode. The center electrode may comprise either the scan electrode where the first electrode and the second electrode comprise the sustain electrode, or the sustain electrode where the first electrode and the second electrode comprise the scan electrode.

At least one of the first electrode, the second electrode or the center electrode may comprise a bus electrode.

The plurality of division electrodes may comprise a first division electrode and a second division electrode. The first division electrode may be located to the first electrode than the second electrode. The second division electrode may be located closer to the second electrode than the first electrode.

The lengths of at least one of first discharge gaps formed between the first electrode and the first division electrode and second discharge gaps formed between the second electrode and the second division electrode may approximately equal to one another.

At least one of the first electrode, the second electrode or the first and second division electrodes may comprise a plurality of projecting electrodes.

The plurality of projecting electrodes of at least one of the first electrode and the second electrode may project toward the first and second division electrodes.

The plurality of projecting electrodes of the first division electrode may project toward the first electrode, and the plurality of projecting electrodes of the second division electrode may project toward the second electrode.

At least one of the first electrode and the second electrode may comprise a plurality of branch electrodes projecting in a direction parallel to adjacent sides of the first and second division electrodes.

When at least one of the first electrode and the second electrode comprises the plurality of branch electrodes, the lengths of at least one of first discharge gaps formed between the plurality of branch electrodes of the first electrode and the adjacent side of the first division electrode and second discharge gaps formed between the plurality of branch electrodes of the second electrode and the adjacent side of the second division electrode may approximately equal to one another.

When at least one of the first electrode and the second electrode comprises the plurality of branch electrodes, at least one of the first electrode, the second electrode or the first and second division electrodes may comprise a plurality of projecting electrodes.

When at least one of the first electrode and the second electrode comprises the plurality of branch electrodes, the plurality of projecting electrodes of at least one of the first electrode and the second electrode may project toward the first and second division electrodes.

When at least one of the first electrode and the second electrode comprises the plurality of branch electrodes, the plurality of projecting electrodes of the first division electrode may project toward the first electrode, and the plurality of projecting electrodes of the second division electrode may project toward the second electrode.

The shortest length of each of the first and second discharge gaps may range from 30 μm to 70 μm.

The width of a section of at least one of the first electrode, the second electrode or the center electrode may range from 20 μm to 60 μm.

A plasma display panel according to the embodiments of the present invention comprises a first substrate and a second substrate, a first electrode and a second electrode formed on the first substrate, a center electrode comprising a plurality of division electrodes for forming a plurality of discharge gaps between the first electrode and the center electrode and between the second electrode and the center electrode, and a third electrode formed on the second substrate to intersect the center electrode.

The width of a portion of the third electrode intersecting the center electrode may be more than the width of a non-intersecting portion of the third electrode.

The third electrode may comprise a third division electrode divided at a location intersecting the center electrode.

Hereinafter, exemplary embodiments of the present invention will be described in detail with reference to the attached drawings.

FIG. 1 illustrates a plasma display panel according to an embodiment of the present invention.

Referring to FIG. 1, a plasma display panel comprises a first panel 100 and a second panel 110 which are coupled in parallel to oppose to each other at a given distance therebetween. The first panel 100 comprises a first substrate 101 on which an image is displayed. The second panel 110 comprises a second substrate 111 constituting a rear surface. A first electrode 102, a second electrode 103 and a center electrode 104 are formed on the first substrate 101. A third electrode 113 is arranged on the rear substrate 111 to intersect the first electrode 102, the second electrode 103 and the center electrode 104.

The first electrode 102, the second electrode 103 and the center electrode 104 each comprise a bus electrode made of a metal material. The first electrode 102, the second electrode 103 and the center electrode 104 generate a mutual discharge in one discharge cell and maintain emissions of discharge cells.

The explanation was given of an example where the first electrode 102, the second electrode 103 and the center electrode 104 each comprise the bus electrode made of the metal material, in FIG. 1. However, the first electrode 102, the second electrode 103 and the center electrode 104 each may comprise a transparent electrode made of a transparent indium-tin-oxide (ITO) material and the bus electrode made of the metal material.

The first electrode 102, the second electrode 103 and the center electrode 104 are covered with one or more upper dielectric layers 105 for limiting a discharge current and providing insulation between the electrodes. A protective layer 106 with a deposit of MgO is formed on an upper surface of the upper dielectric layer 105 to facilitate discharge conditions.

A plurality of stripe-type (or well-type) barrier ribs 112 are formed in parallel on the second substrate 111 of the second panel 110 to form a plurality of discharge spaces, that is, a plurality of discharge cells. The plurality of third electrodes 113 are arranged in parallel with the barrier ribs 112 to perform an address discharge and generate vacuum ultraviolet rays.

Red (R), green (G) and blue (B) phosphors 114 are coated on an upper surface of the second panel 110 to emit visible light for displaying an image during the generation of the address discharge. A lower dielectric layer 115 is formed between the third electrodes 113 and the phosphors 114 to protect the third electrodes 113.

Only an example of the plasma display panel applicable to the embodiment of the present invention was illustrated in FIG. 1. However, the embodiment of the present invention is not limited to the structure of the plasma display panel illustrated in FIG. 1.

For example, the upper dielectric layer 105 had the uniform thickness in FIG. 1. However, the thickness and dielectric constant of the upper dielectric layer 105 may change. Further, a distance between the barrier ribs 112 was fixed in FIG. 1. However, the distance between the barrier ribs 112 may change. For example, a distance between barrier ribs forming the blue discharge cell may be wider than another distance between barrier ribs.

Further, the side of the barrier rib 112 may has an uneven shape, and the phosphor 114 coated on the barrier rib 112 may be formed in conformity with the uneven shape of the barrier rib 112. Accordingly, brightness of an image displayed on the plasma display panel is improved.

When manufacturing the plasma display panel, a tunnel may be formed at the side of the barrier 112 to improve an exhaust characteristic.

Figure 2:
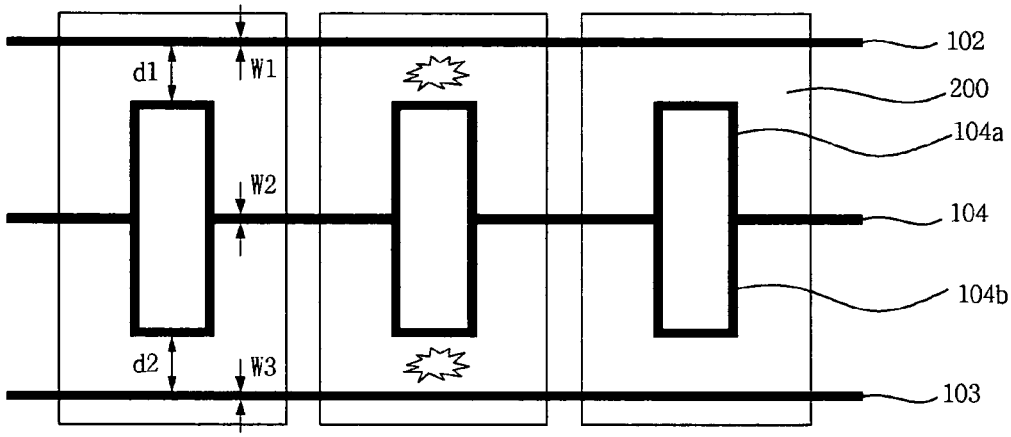
FIG. 2 illustrates a first electrode, a second electrode and a center electrode in the plasma display panel of FIG. 1.
Figure 2:
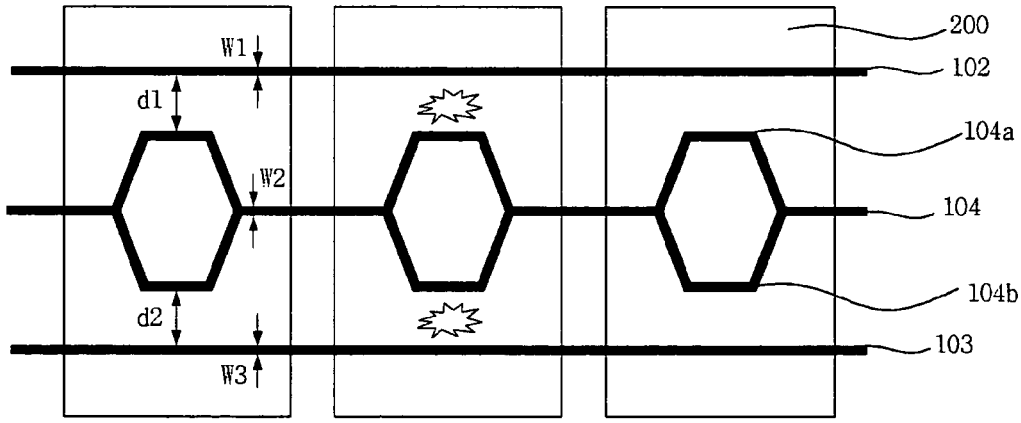

The following is a detailed description of the first electrode 102, the second electrode 103 and the center electrode 104 formed on the first substrate 101, with reference to FIG. 2.

FIG. 2 illustrates a first electrode, a second electrode and a center electrode in the plasma display panel of FIG. 1.

As illustrated in FIG. 2, when viewing the front of the plasma display panel of FIG. 1, the first electrode 102 and the second electrode 103 are formed on the first substrate 102. Further, the center electrode 104 is formed between the first electrode 102 and the second electrode 103. The center electrode 104 comprises a plurality of division electrodes 104*a* and 104*b* forming a plurality of discharge gaps d1 and d2.

As illustrated in (a) and (b) of FIG. 2, the center electrode 104 may have various shapes.

The division electrodes 104*a* and 104*b* of the center electrode 104 comprise a first division electrode 104*a* and a second division electrode 104*b* divided in a discharge cell 200.

As illustrated in FIG. 2, the first division electrode 104*a* is located closer to the first electrode 102 than the second electrode 103. The second division electrode 104 is located closer to the second electrode 103 than the first electrode 102.

When the first electrode 102, the second electrode 103 and the center electrode 104 are formed in the plasma display panel, the plurality of discharge gaps d1 and d2 are formed within one discharge cell 200. Accordingly, the brightness of the image displayed on the plasma display panel is improved.

For example, when a scan electrode and a sustain electrode are formed within a discharge cell, one discharge gap is formed in the center of the discharge cell. Accordingly, the most of emission due to the phosphor is generated in the center of the discharge cell in which the discharge gap is formed.

However, when the electrodes are formed as illustrated in FIG. 2, the plurality of discharge gaps are formed. More specifically, since the discharge gaps d1 and d2 are formed between the first electrode 102 and the center electrode 104 and between the second electrode 103 and the center electrode 104, respectively, the emission due to the phosphor is generated in several portions of the discharge cell 200. Accordingly, the brightness of the plasma display panel is further improved.

The first electrode 102 and the second electrode 103 function as the scan electrode or the sustain electrode. The center electrode 104 functions as either the sustain electrode where the first electrode 102 and the second electrode 103 function as the scan electrode, or the scan electrode where the first electrode 102 and the second electrode 103 function as the sustain electrode.

At least one of the first electrode 102, the second electrode 103 or the center electrode 104 may comprise only the bus electrode without the transparent electrode. Accordingly, the manufacturing cost decreases.

Further, since a process for forming the transparent electrode is omitted in the manufacturing method of the plasma display panel, the manufacturing yield is improved.

The shortest length of each of the discharge gaps d1 and d2 ranges from 30 μm to 70 μm.

When the shortest length of each of the discharge gaps d1 and d2 is 30 μm or more, the discharge gap is prevented from being narrowly formed and the discharge gaps having the proper size are formed within the discharge cell 200.

When the shortest length of the discharge gaps d1 and d2 is 70 μm or less, a discharge is generated at a proper firing voltage level.

At least one of widths w1, w2 or w3 of sections of the first electrode 102, the center electrode 104 or the second electrode 103 ranges from 20 μm to 60 μm.

When at least one of widths w1, w2 or w3 of the sections of the first electrode 102, the center electrode 104 or the second electrode 103 is 20 μm or more, a current properly flows without severe disturbance caused by a resistance of the electrode to which a current with proper capacitance is supplied.

When at least one of widths w1, w2 or w3 of the sections of the first electrode 102, the center electrode 104 or the second electrode 103 is 60 μm or less, an aperture ratio of the discharge cell 200 is maintained at a proper level such that the brightness of the plasma display panel is maintained at a proper level.

The explanation was given of an example of the basic structures of the first electrode 102, the second electrode 103 and the center electrode 104 in FIG. 2. However, the shapes of the first electrode 102, the second electrode 103 may change corresponding to the shape of the center electrode 104. This will be described in detail with reference to FIG. 3.

Figure 3:
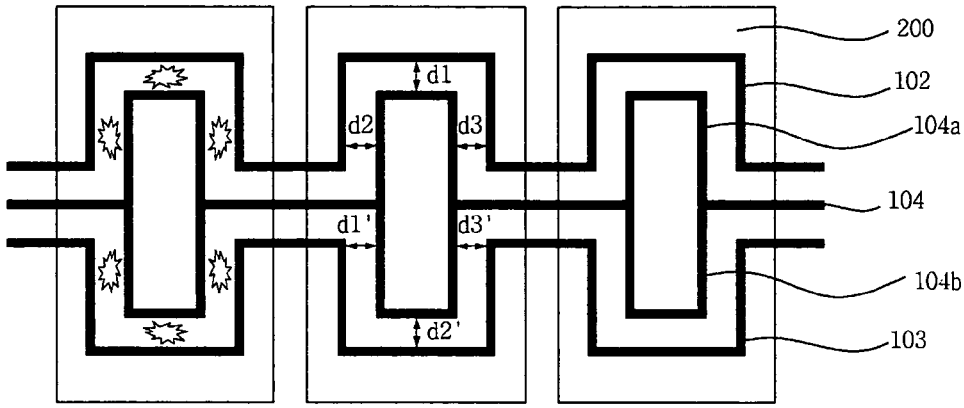
FIG. 3 illustrates an example where at least one of the first electrode and the second electrode is formed corresponding to a shape of the center electrode.
Figure 3:
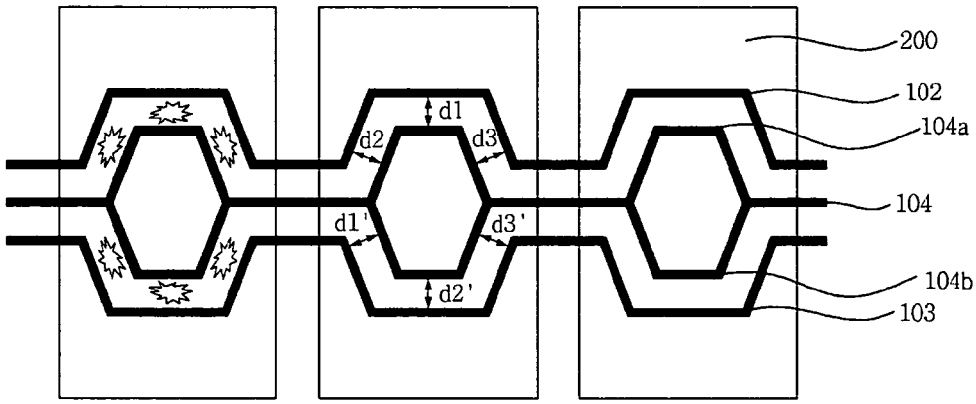

FIG. 3 illustrates an example where at least one of the first electrode and the second electrode is formed corresponding to a shape of the center electrode.

As illustrated in (a) and (b) of FIG. 3, the first electrode 102 is formed corresponding to the shape of the first division electrode 104*a*. The lengths of first discharge gaps d1, d2 and d3 formed between the first electrode 102 and the first division electrode 104*a* approximately equal to one another.

Further, the second electrode 103 is formed corresponding to the shape of the second division electrode 104*b*. The lengths of second discharge gaps d1', d2' and d3' formed between the second electrode 103 and the second division electrode 104*b* are approximately equal to one another.

In FIG. 3, the lengths of at least one of the first discharge gaps d1, d2 and d3 and the second discharge gaps d1', d2' and d3' are approximately equal to one another. Therefore, magnitudes of the discharges generated in all of the regions of the discharge cell 200 are approximately equal to one another such that the discharge is uniformly generated in the discharge cell 200.

Accordingly, an area of a discharge region of the discharge cell 200, where the discharge is generated, increases and the brightness is further improved.

Figure 4:
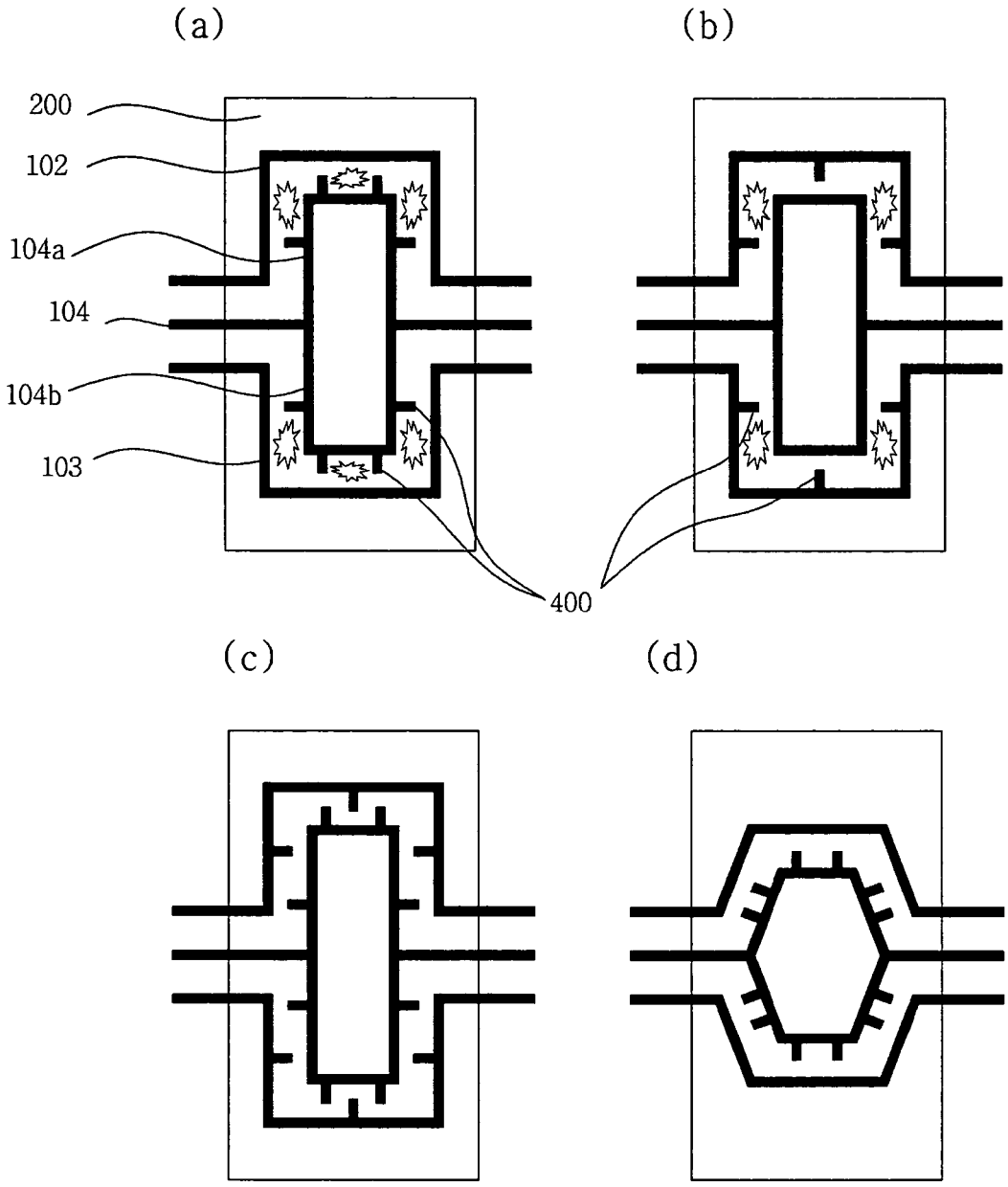
FIG. 4 illustrates an example where at least one of the first electrode, the second electrode or a division electrode comprises a projecting electrode.

FIG. 4 illustrates an example where at least one of the first electrode, the second electrode or a division electrode comprises a projecting electrode.

As illustrated in (a), (b), (c) and (d) of FIG. 4, at least one of the first electrode 102, the second electrode 103 or the division electrodes 104*a* and 104*b* comprise a plurality of projecting electrodes 400.

As illustrated in (a) of FIG. 4, in a case where the center electrode 104 comprises the plurality of projecting electrodes 400, the plurality of projecting electrodes 400 of the first division electrode 104*a* project toward the first electrode 102, and the plurality of projecting electrodes 400 of the second division electrode 104*b* project toward the second electrode 103.

In such a case, the discharge gaps are formed between the first division electrode 104*a* and the first electrode 102, and between the second division electrode 104*b* and the second electrode 103. Since the plurality of projecting electrodes 400 are formed in a direction of discharge generation, an initial discharge is easier and more sensitively generated.

More charges are formed in an end of a conductor than a body of the conductor in accordance with a physical characteristic of the conductor. Therefore, more wall charges are formed in a portion where the projecting electrodes 400 are formed within the discharge cell 200 than a portion where the projecting electrodes 400 are not formed within the discharge cell 200. Accordingly, the discharge is more sensitively and easier generated in the portion where the projecting electrodes 400 are formed within the discharge cell 200.

As illustrated in (b) of FIG. 4, in a case where at least one of the first electrode 102 and the second electrode 103 comprises the plurality of projecting electrodes 400, the plurality of projecting electrodes 400 project toward the division electrodes 104*a* and 104*b*.

As illustrated in (c) of FIG. 4, in a case where the first electrode 102, the second electrode 103 and the division electrodes 104*a* and 104*b* each comprise the plurality of projecting electrodes 400, the discharge is easier generated.

As illustrated in (d) of FIG. 4, the first electrode 102, the second electrode 103 and the division electrodes 104*a* and 104*b* may have a shape different from the shapes of the electrodes 102, 103, 104*a*, 104*b* illustrated in (a),(b) and (c) of FIG. 4. In such a case, as illustrated in (a), (b) and (c) of FIG. 4, at least one of the first electrode 102, the second electrode 103 or the division electrodes 104*a* and 104*b* may comprise the plurality of projecting electrodes 400. In (d) of FIG. 4, the division electrodes 104*a* and 104*b* comprise the plurality of projecting electrodes 400.

Figure 5:
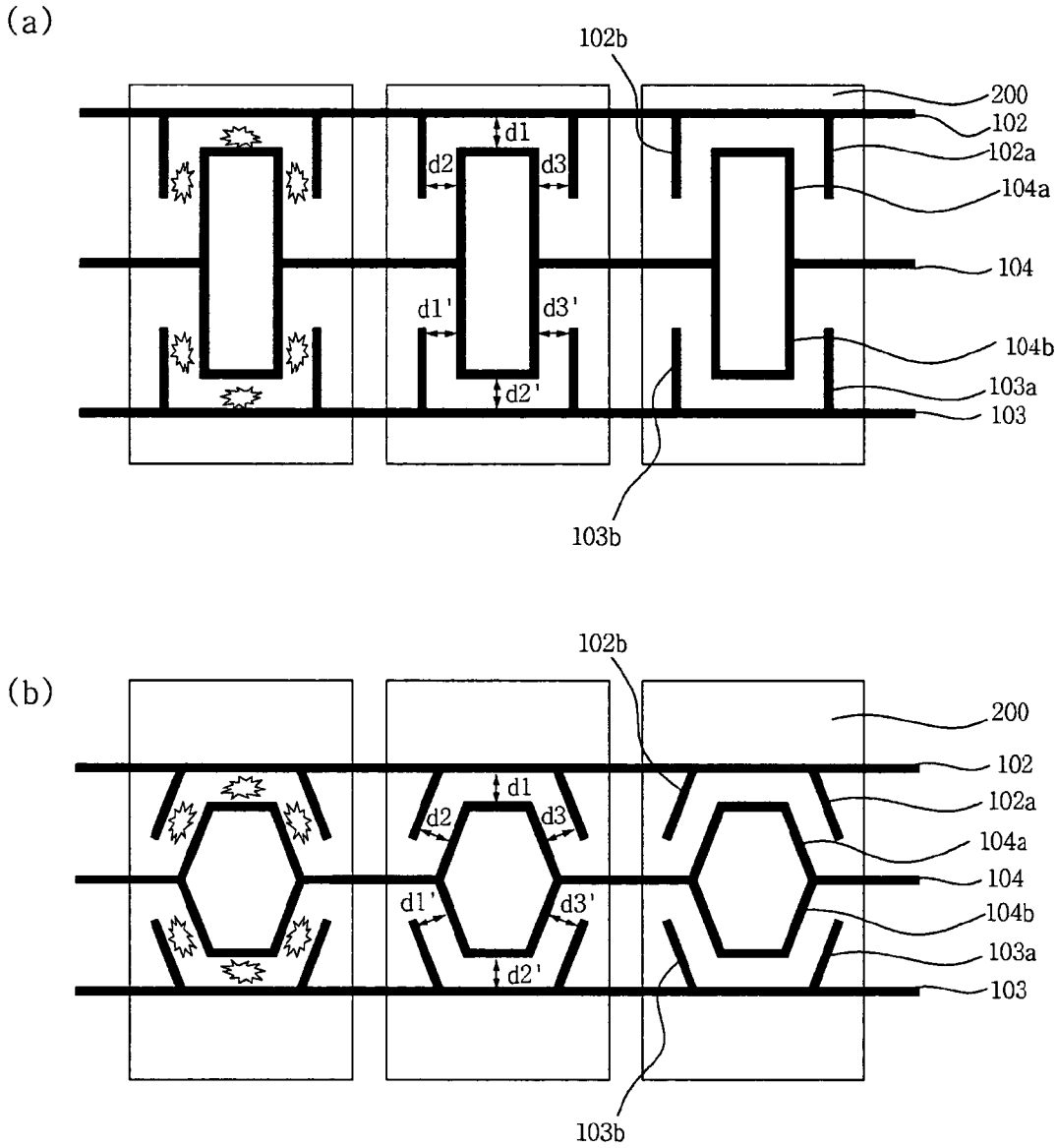
FIG. 5 illustrates an example where at least one of the first electrode and the second electrode comprises a branch electrode.

FIG. 5 illustrates an example where at least one of the first electrode and the second electrode comprises a branch electrode.

As illustrated in (a) and (b) of FIG. 5, at least one of the first electrode 102 and the second electrode 103 further comprises a plurality of branch electrodes 102*a*, 102*b*, 103*a*, 103*b* projecting in a direction parallel to adjacent sides of the division electrodes 104*a* and 104*b*.

The plurality of branch electrodes 102*a*, 102*b*, 103*a*, 103*b* widen the discharge region within the discharge cell 200, thereby improving the brightness of the plasma display panel.

The lengths of first discharge gaps d1, d2 and d3 formed between the branch electrodes 102*a* and 102*b* of the first electrode 102 and the adjacent side of the first division electrode 104*a* are approximately equal to one another.

The lengths of second discharge gaps d1', d2' and d3' formed between the branch electrodes 103*a* and 103*b* of the second electrode 103 and the adjacent side of the second division electrode 104*b* are approximately equal to one another.

In FIG. 5, the lengths of at least one of first discharge gaps d1, d2 and d3 and second discharge gaps d1', d2' and d3' are approximately equal to one another. Therefore, magnitudes of the discharges generated in all of the regions of the discharge cell 200 are approximately equal to one another such that the discharge is uniformly generated in the discharge cell 200.

When at least one of the first electrode 102 and the second electrode 103 comprises the branch electrodes 102*a*, 102*b*, 103*a*, 103*b*, at least one of the first electrode 102, the second electrode 103 and the division electrodes 104*a* and 104*b* may comprise the projecting electrodes. This will be described in detail with reference to FIG. 6.

Figure 6:
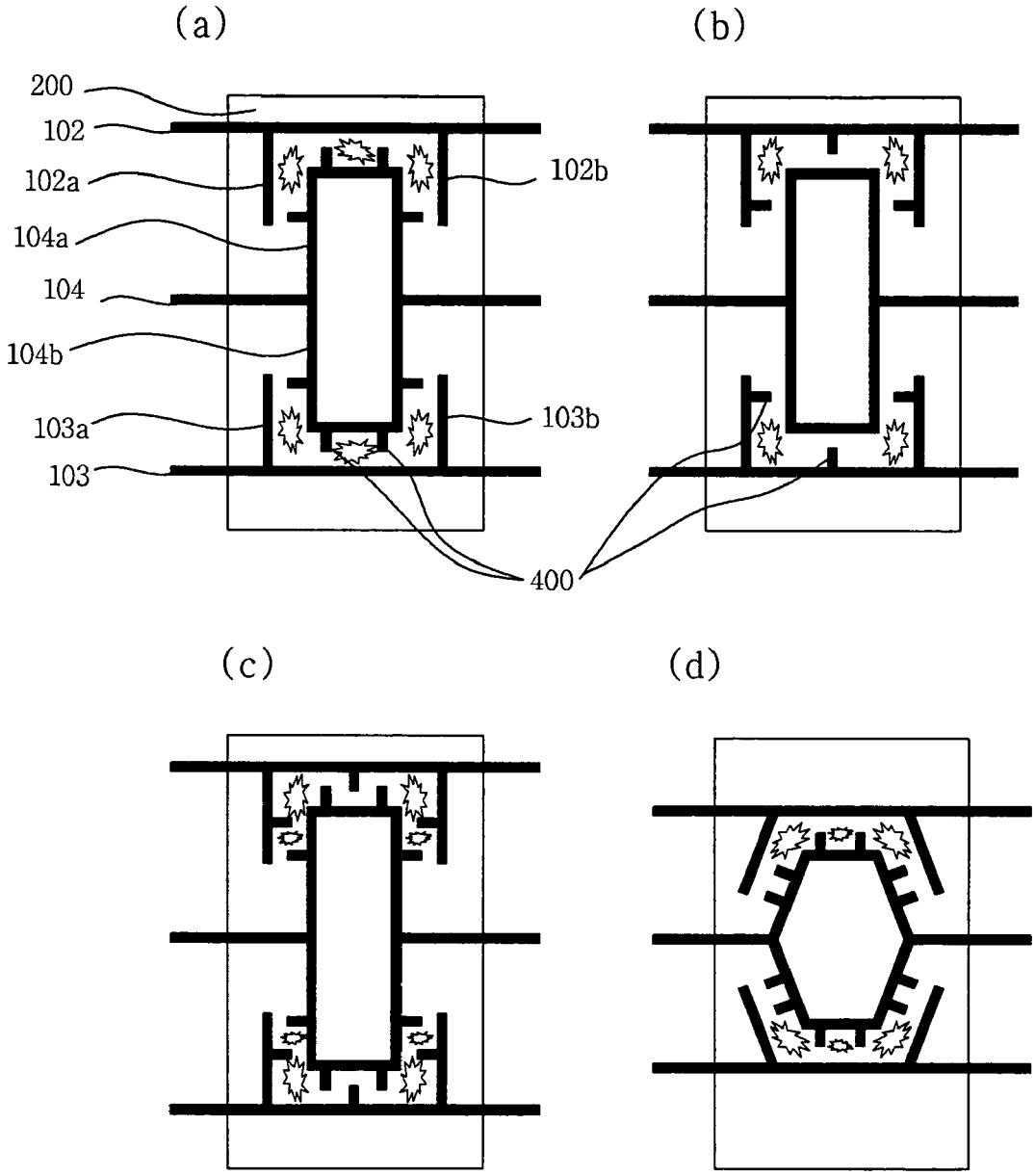
FIG. 6 illustrates an example where at least one of the first electrode, the second electrode or the division electrode comprises the projecting electrode when at least one of the first electrode and the second electrode comprises the branch electrode.

FIG. 6 illustrates an example where at least one of the first electrode, the second electrode or the division electrode comprises the projecting electrode when at least one of the first electrode and the second electrode comprises the branch electrode.

As illustrated in (a), (b), (c) and (d) of FIG. 6, at least one of the first electrode 102, the second electrode 103 or the division electrodes 104*a* and 104*b* comprises the plurality of projecting electrodes 400.

As illustrated in (a) of FIG. 6, when the first and second division electrodes 104*a* and 104*b* of the center electrode 104 comprise the plurality of projecting electrodes 400, the plurality of projecting electrodes 400 of the first division electrode 104*a* project toward the first electrode 102, and the plurality of projecting electrodes 400 of the second division electrode 104*b* project toward the second electrode 103.

As illustrated in (b) of FIG. 6, when at least one of the first electrode 102 and the second electrode 103 comprises the plurality of projecting electrodes 400, the plurality of projecting electrodes 400 project toward the first and second division electrodes 104*a* and 104*b*.

As illustrated in (c) of FIG. 6, when the first electrode 102, the second electrode 103 and the division electrodes 104*a* and 104*b* each comprise the plurality of projecting electrodes 400, the discharge is easier generated.

As illustrated in (d) of FIG. 6, the first electrode 102, the second electrode 103 and the division electrodes 104*a* and 104*b* may have a shape different from the shapes of the electrodes 102, 103, 104*a*, 104*b* illustrated in (a),(b) and (c) of FIG. 6. In such a case, as illustrated in (a), (b) and (c) of FIG. 6, at least one of the first electrode 102, the second electrode 103 or the division electrodes 104*a* and 104*b* may comprise the plurality of projecting electrodes 400. In (d) of FIG. 6, the division electrodes 104*a* and 104*b* comprise the plurality of projecting electrodes 400.

The explanation was given examples of the first electrode 102, the second electrode 103 and the center electrode 104 formed on the first substrate. However, the following is a detailed description of the third electrode 113, with reference to FIG. 7.

Figure 7:
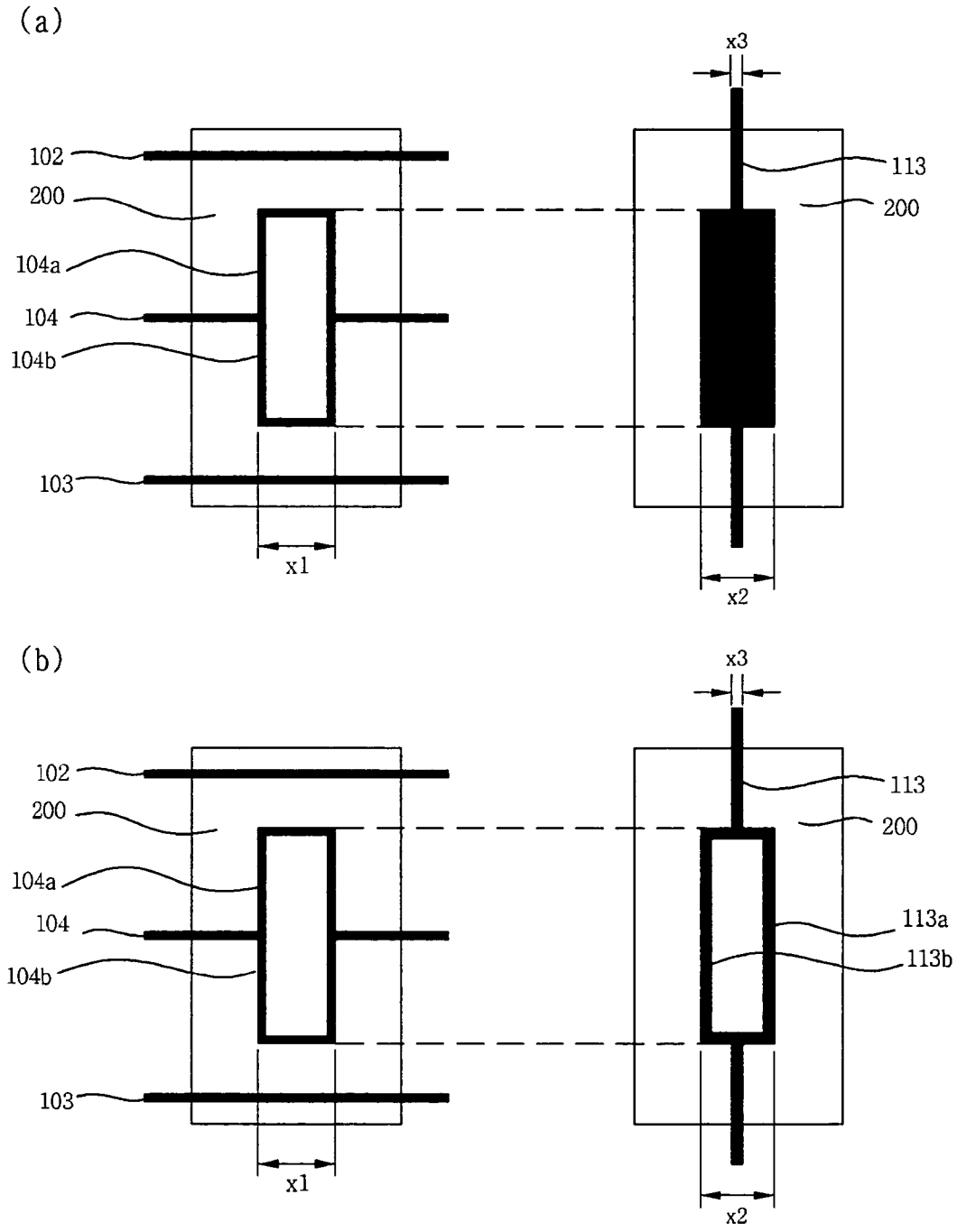
FIG. 7 illustrates a third electrode formed on a second substrate in the plasma display panel of FIG. 1.

FIG. 7 illustrates a third electrode formed on a second substrate in the plasma display panel of FIG. 1.

As illustrated in (a) of FIG. 7, the first electrode 102 and the second electrode 103 are formed on the first substrate (not shown). The center electrode 104 is formed between the first electrode 102 and the second electrode 103. The center electrode 104 comprises the first and second division electrodes 104*a* and 104*b* for forming the plurality of discharge gaps. The third electrode 113 is formed on the second substrate (not shown) to intersect the center electrode 104.

The first electrode 102 and the second electrode 103 may function as a sustain electrode, and the center electrode 104 may function as a scan electrode.

A width x2 of a portion of the third electrode 113 intersecting the center electrode 104 is more than a width x3 of a non-intersecting portion of the third electrode 113.

The width x2 of the portion of the third electrode 113 intersecting the center electrode 104 may approximately equal to a width x1 of a portion formed by the division electrodes 104*a* and 104*b*.

Accordingly, an area of an intersection portion of the center electrode 104 and the third electrode 113 increases. An increase in the intersection area more easily occurs an opposite discharge within the discharge cell 200 between the first substrate and the second substrate when a scan signal is supplied to the center electrode 104 and a data signal is supplied to the third electrode 113.

Since the intersection area of the center electrode 104 and the third electrode 113 increases, a more stable address discharge is generated and an address discharge is generated at high speed.

The third electrode 113 may comprise a bus electrode with low reflectivity.

As illustrated in (b) of FIG. 7, the third electrode 113 may comprise a plurality of division electrodes 113*a* and 113*b* divided at a location intersecting the center electrode 104.

Accordingly, while the effect of the opposite discharge is maintained, a material used in the formation of the third electrode 113 decreases such that the manufacturing cost decreases.

The embodiment of the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display panel comprising:

a first substrate;

a first electrode and a second electrode formed on the first substrate;

a center electrode formed on the first substrate and spaced apart from the first electrode and the second electrode, wherein the center electrode includes a plurality of division electrodes for forming a plurality of discharge gaps between the first electrode and the center electrode and between the second electrode and the center electrode; and a open part that is partitioned between two of the division electrodes, wherein a width of the open part in a direction crossing the first electrode and the second electrode is greater than a width of the open part in a direction parallel to the first electrode and the second electrode.

2. The plasma display panel of claim 1, wherein the first electrode and the second electrode comprise either a scan electrode or a sustain electrode, and the center electrode comprises either the scan electrode where the first electrode and the second electrode comprise the sustain electrode, or the center electrode comprises the sustain electrode when the first electrode and the second electrode comprise the scan electrode.

3. The plasma display panel of claim 1, wherein at least one of the first electrode, the second electrode or the center electrode comprises a bus electrode.

4. The plasma display panel of claim 1, wherein the plurality of division electrodes comprise a first division electrode and a second division electrode, the first division electrode is located closer to the first electrode than the second electrode, and the second division electrode is located closer to the second electrode than the first electrode.

5. The plasma display panel of claim 4, wherein a length of at least one of first discharge gaps formed between the first electrode and the first division electrode is approximately equal to a length of at least one of second discharge gaps formed between the second electrode and the second division electrode.

6. The plasma display panel of claim 5, wherein at least one of the first electrode, the second electrode or the first and second division electrodes comprises a plurality of projecting electrodes.

7. The plasma display panel of claim 6, wherein the plurality of projecting electrodes of at least one of the first electrode and the second electrode project toward the first and second division electrodes.

8. The plasma display panel of claim 6, wherein the plurality of projecting electrodes of the first division electrode project toward the first electrode, and the plurality of projecting electrodes of the second division electrode project toward the second electrode.

9. The plasma display panel of claim 4, wherein at least one of the first electrode and the second electrode comprises a plurality of branch electrodes projecting in a direction parallel to adjacent sides of the first and second division electrodes.

10. The plasma display panel of claim 9, wherein the length of at least one of first discharge gaps formed between the plurality of branch electrodes of the first electrode and the adjacent side of the first division electrode is approximately equal to a length of second discharge gaps formed between the plurality of branch electrodes of the second electrode and the adjacent side of the second division electrode.

11. The plasma display panel of claim 10, wherein at least one of the first electrode, the second electrode or the first and second division electrodes comprises a plurality of projecting electrodes.

12. The plasma display panel of claim 11, wherein the plurality of projecting electrodes of at least one of the first electrode and the second electrode project toward the first and second division electrodes.

13. The plasma display panel of claim 12, wherein the plurality of projecting electrodes of the first division electrode project toward the first electrode, and the plurality of projecting electrodes of the second division electrode project toward the second electrode.

14. The plasma display panel of claim 1, wherein the shortest length of each of the first and second discharge gaps ranges from 30 μm to 70 μm.

15. The plasma display panel of claim 1, wherein the width of a section of at least one of the first electrode, the second electrode or the center electrode ranges from 20 μm to 60 μm.

16. A plasma display panel comprising:

a first substrate and a second substrate;

a first electrode and a second electrode formed on the first substrate;

a center electrode formed on the first substrate and spaced apart from the first electrode and the second electrode, the center electrode including a plurality of division electrodes for forming a plurality of discharge gaps between the first electrode and the center electrode and between the second electrode and the center electrode;

a third electrode formed on the second substrate to intersect the center electrode; and an open part that is partitioned between two of the division electrodes, wherein a width of the open part in a direction crossing the first electrode and the second electrode is greater than a width of the open part in a direction parallel to the first electrode and the second electrode.

17. The plasma display panel of claim 16, wherein a width of a portion of the third electrode intersecting the center electrode is greater than a width of a non-intersecting portion of the third electrode.

18. The plasma display panel of claim 16, wherein the third electrode comprises a third division electrode divided at a location intersecting the center electrode.

19. A plasma display panel comprising:

a first substrate and a second substrate formed with given distance;

a first electrode and a second electrode formed on the first substrate; a center electrode formed on the first substrate and spaced apart from the first electrode and the second electrode, the center electrode including two division electrodes; and a third electrode formed on the second substrate to intersect the center electrode, wherein a width of a portion of the third electrode intersecting the center electrode is greater than a width of a non-intersecting portion of the third electrode, and an interval between the two division electrodes in a direction crossing the first electrode and the second electrode is greater than an interval between the two division electrodes in a direction parallel to the first electrode and the second electrode.

20. The plasma display panel of claim 19, wherein the third electrode comprises a third division electrode divided at a portion intersecting the center electrode.

* * * * *